US008652741B2

(12) United States Patent
Fowlkes

(10) Patent No.: US 8,652,741 B2
(45) **Date of Patent: *Feb. 18, 2014**

(54) ENHANCEMENT OF DISCHARGED AREA DEVELOPED TONER LAYER

(75) Inventor: William Y. Fowlkes, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/018,188

(22) Filed: Jan. 31, 2011

(65) Prior Publication Data

US 2012/0195642 A1 Aug. 2, 2012

(51) Int. Cl.
*G03G 13/16* (2006.01)

(52) U.S. Cl.
USPC ..... 430/125.3; 430/42.1; 430/45.31

(58) Field of Classification Search
USPC ..... 430/42.1, 45.31, 123.5, 123.52, 124.1, 430/125.3, 125.5
See application file for complete search history.

(56) References Cited

U.S. PATENT DOCUMENTS

| | | | | |
|---|---|---|---|---|
| 3,724,422 | A | 4/1973 | Latone et al. | |
| 3,927,641 | A | 12/1975 | Handa | |
| 4,041,903 | A | 8/1977 | Katakura et al. | |
| 4,937,629 | A * | 6/1990 | Maruyama et al. | 399/232 |
| 5,234,783 | A | 8/1993 | Ng | |
| 5,905,012 | A | 5/1999 | De Meutter et al. | |
| 5,926,679 | A | 7/1999 | May et al. | |
| 6,608,987 | B2 | 8/2003 | Bartscher et al. | |
| 6,880,463 | B2 | 4/2005 | DeMeulemeester et al. | |
| 7,016,621 | B1 | 3/2006 | Ng | |
| 7,120,379 | B2 | 10/2006 | Eck et al. | |
| 7,389,073 | B2 | 6/2008 | Kumar et al. | |
| 8,007,969 | B2 * | 8/2011 | Lieberman | 430/45.31 |
| 8,092,970 | B2 * | 1/2012 | Tyagi et al. | 430/124.1 |
| 8,158,313 | B2 * | 4/2012 | Tsukamoto et al. | 430/45.1 |
| 2002/0168200 | A1 | 11/2002 | Stelter et al. | |
| 2009/0162113 | A1 | 6/2009 | Solcz et al. | |
| 2012/0195614 | A1 * | 8/2012 | Fowlkes | 399/55 |
| 2012/0196223 | A1 * | 8/2012 | Fowlkes | 430/124.1 |

FOREIGN PATENT DOCUMENTS

| | | |
|---|---|---|
| JP | 62-049377 | 3/1987 |
| JP | 2000-231279 | 8/2000 |
| JP | 2005-189719 | 7/2005 |
| JP | 2007-328061 | 12/2007 |

OTHER PUBLICATIONS

IS & T's 1997 International Conference on Digital Printing Technologies, UV-cured Toners for Printing and Coating on Paper-like Substrates, pp. 168-172, Detlef Schuzle-Hagenest, Micheal Huber, Saskia Udding-Louwrier and Paul H.G. Binda.

* cited by examiner

*Primary Examiner* — Stewart Fraser
(74) *Attorney, Agent, or Firm* — Roland R. Schindler, II

(57) ABSTRACT

Methods for printing are provided. In one aspect a primary imaging member having a pattern of engine pixel locations with image modulated differences of potential and with first toner having a first toner difference of potential is moved to a second development station. A second development difference of potential of the first polarity at the second development station forms a second net development difference of the second development difference of potential less any image modulated difference of potential at the individual engine pixel location and less any difference of potential relative to ground of any first toner at the individual engine pixel location. The second development difference of potential is greater than the first development difference of potential so that second toner that is different from the first toner, is developed onto the first toner using the second net development difference of potential.

16 Claims, 12 Drawing Sheets

ENHANCEMENT OF DISCHARGED AREA DEVELOPED TONER LAYER

CROSS REFERENCE TO RELATED APPLICATIONS

This application relates to commonly assigned, copending U.S. application Ser. No. 13/018,158, filed Jan. 31, 2011, entitled: "ENHANCEMENT OF CHARGE AREA DEVELOPED TONER LAYER"; U.S. application Ser. No. 13/018,172, filed Jan. 31, 2011, entitled: "BALANCING DISCHARGE AREA DEVELOPED AND TRANSFERRED TONER"; U.S. application Ser. No. 13/018,148, filed Jan. 31, 2011, entitled: "BALANCING CHARGE AREA DEVELOPED AND TRANSFERRED TONER"; U.S. application Ser. No. 13/018,183, filed Jan. 31, 2011, entitled: "PRINTER WITH DISCHARGE AREA DEVELOPED TONER BALANCING"; and U.S. application Ser. No. 13/108,136, filed Jan. 31, 2011, entitled: "PRINTER WITH CHARGE AREA DEVELOPED TONER BALANCING each of which is hereby incorporated by reference.

FIELD OF THE INVENTION

This invention pertains to the field of printing.

BACKGROUND OF THE INVENTION

In color electrophotography, a full color image is built up by sequentially transferring individual color separation toner images in registration onto a receiver and fusing the toner and receiver. A clear toner can also be provided over the color separation toner images. Such a clear toner protects the color separation toner images from damage due to environmental conditions or from incidental contact.

A clear toner can also improve the gloss of the full color image. Gloss is an optical property that represents the extent to which a surface such as an exterior surface of a fused toner image reflects light at an angle that mirrors an angle of incidence of that light. Several factors can influence the gloss of a toner image fused to a receiver. The primary factors include the general uniformity of the refractive index of the toner used to form the exterior surface of the fused toner image, the flatness of the exterior surface of the fused toner image, and in certain circumstances, the gloss of the receiver.

It will be appreciated that a full color toner image can have an exterior surface that includes toner from any of the color separation toner toners as may be necessary to provide the desired combination of colors and the index of refraction of the toner that is present at an upper layer of the full color toner image can vary with the index of refraction of the color separation toner that is last applied at each layer of the toner stack. Light that strikes the exterior surface at an angle of incidence can be reflected at different angles because of such differences in the index of refraction. Accordingly, a more uniform index of refraction can be provided at an exterior surface of a fused color toner image by providing a common clear toner over the color separation toners.

It is known in the art to apply such a clear layer to color separation images using a clear coating apparatus that applies, for example, a generally uniform coating of a clear material and that fixes the clear material to the toner image by exposing this material to ultraviolet light. For example, Schulze-Hagenest, et al., disclose UV-curable toners for use to form durable prints on paper and cardboard substrates in UV-cured Toners for Printing and Coating on Paper-like Substrates, 13th International Conference on Digital Printing Technologies (Imaging Science and Technology, 1997) pp. 168-172. Also described is apparatus for the UV curing (crosslinking) of such UV-curable toners at elevated temperatures, i.e., above the glass transition temperature (T.sub.g) of the toner. A radiant fusing step, using IR radiation to heat the toner, is followed by a separate UV curing step in which the toner is in a molten or quasi-molten state. The IR pre-fusing provides a smooth film, while the subsequent UV curing reaction is very rapid. UV-crosslinkable toner formulations are disclosed in U.S. Pat. No. 6,608,987 issued to Bartscher, et al. and in U.S. Pat. No. 5,905,012 issued to De Meutter, et al.

In another example, U.S. Pat. No. 5,926,679, issued to May, et al., discloses that a clear (non-marking) toner layer can be laid down on a photoconductive member (e.g., imaging cylinder) prior to forming a marking particle toner image thereon, and that a clear toner layer can be laid down as a last layer on top of a marking particle toner image prior to transfer of the image to an intermediate transfer member (e.g., blanket cylinder). It is also disclosed that a clear toner layer can be laid down on a blanket cylinder prior to transferring a marking particle toner image from a photoconductive member. In one aspect of this patent, a non-imagewise clear toner layer is bias-developed on to an intermediate transfer member using a uniform charger and a non-marking toner development station. A first monocolor toner image corresponding to one of the marking toners is transferred to the ITM (on top of the clear toner) from a primary imaging member which may be a roller or a web but is preferably a roller. Subsequently, a second monocolor toner image corresponding to another of the marking toners is transferred to the ITM (on top of and in registration with the first toner image) and so forth until a completed multicolor image stack has been transferred on top of the clear toner on the ITM. The ITM is then positioned at a sintering exposure station; where a sintering radiation is turned on to sinter the toner image for a predetermined length of time.

The clear toner that is applied to the color separation toner images in accordance with such methods can provide the protective function and can also create a generally uniform index of refraction at the exterior surface of a fused toner image formed on the receiver after fusing to provide improved gloss performance.

However, differences in the amount of color separation toner applied to form different colors form what are known as toner stacks and can cause different the toner stacks to have a different toner stack heights. The difference between toner stack heights can cause relief differentials to exist in the exterior surface of the fused toner image. The relief differentials disrupt the flatness of the exterior surface of such a color toner image. These relief differentials cause light to reflect along different paths and this, in turn, reduces the apparent gloss of the fused toner image.

This effect can be illustrated by reference to FIGS. 1 and 2. FIG. 1 depicts an exemplary section of a receiver member 2 having a plurality of color toner stacks 4A-4N. As can be seen from FIG. 1, color toner stacks 4A-4N provide a range of color toner stack heights before fusing, with the toner stack heights varying based upon the total amount of color toner in each toner stack. As is also seen in FIG. 1, a uniform layer of clear toner uniformly increases the toner stack heights leaving the magnitude of any toner stack height differences unchanged but at a higher level relative to receiver 2.

FIG. 2 shows the section of FIG. 1 after fusing. As is shown in FIG. 2, the pressure and heat applied during a typical fusing process tends to cause the color toner stacks to be pressed together to form a toner mass 6 having an exterior surface 8.

As is also illustrated in FIG. 2, exterior surface 8 has a relief pattern with peaks that generally correspond to locations on the receiver member 2 on which higher toner stacks 4A-4N are formed and valleys that generally correspond to locations on the receiver member 2 having comparatively lower toner stacks.

For example, a peak area 10 on surface 8 that corresponds to high density color image elements is shown in FIG. 1 as being formed at areas of the toner image formed by toner having comparatively higher toner stack heights e.g. toner stack 4D and a valley area 12 that corresponds to lower density color image elements shown in FIG. 1 as having a lower toner stack height e.g. toner stack 4E in FIG. 1. Such relief differentials reflect incident light from a common source (not shown) in different directions thereby creating a reduction in gloss. For example, as is shown in FIG. 2, parallel rays of light 14A, 14B and 14C strike different portions of fused toner 8, and are at least in part reflected by exterior surface 8 as reflected rays of light 16A, 16B and 16C that travel in different directions. Accordingly, only a portion of the parallel rays 14A, 14B and 14C can be seen by an observer or detector at a position 18 that mirrors the angle of incidence of the parallel rays 14A, 14B, and 14C on surface 10. This reduces the overall apparent gloss level of the toner image formed on receiver member 2.

It will be appreciated from this that the application of a clear toner in amounts that vary inversely with an amount of color toner in a toner stack can reduce these relief differentials and improve gloss. Accordingly, there have been various attempts to use imagewise application of a clear toner to help form a fused toner image having reduced relief differentials. Often this is done by determining a pattern of clear toner that is calculated to provide reduced relief differentials when applied to the toner stacks formed by the color separation toner images that will be applied to a receiver. This pattern is then converted into the form of image data that can be printed by a printing module to provide a toner image that has reduced relief differentials after fusing.

For example, U.S. Pat. No. 5,234,783, issued on Aug. 10, 1993, in the name of Yee S. Ng, describes a process where a gloss of a printed image is improved by applying gloss improving clear toner image to the color toner stacks forming the image. The gloss producing clear toner image provides clear toner in amounts that vary inversely according to the amounts of toner provided by the color separation images providing ultimately an even height toner image. Similarly, U.S. Pat. No. 7,016,621, issued on Mar. 21, 2006 in the name of Yee S. Ng, describes the formation of a toner image wherein back-transfer artifacts are reduced or eliminated without the need or expense of providing uniform coverage of clear toner to the print wherein a five color tandem printer is used to print fewer than five colors. In this patent, the first four printing stations are used to print a color toner image having a range of stack heights and a fifth station is used to deposit a clear toner image having less clear toner in areas of the color separation toner images having more color separation toner and more clear toner in areas of the color toner image having lower amounts of color separation toner.

Such relief reducing applications of toner are known as inverse mask toner images. The use of inverse mask toner images provides high gloss outcomes by helping to cause exterior surface 8 of a fused color toner image to have a consistent index of refraction and reduced relief differentials. Such inverse mask methods can require the use of a printing module to selectively apply clear toner to specific color toner stacks, requires calculation to determine which toner stack are to receive the amounts of clear toner applied according to the inverse mask, requires that the clear toner is carefully written and transferred in register to the underlying color toner stacks. These steps can require precise calculation, electrical and mechanical control.

It will also be understood that in an electrophotographic printer, a development process is used to deposit toner onto a surface. In this process, a development station supplying charged toner is provided in close proximity to an engine pixel location on a primary imaging member. The difference of potential is established across the toner and the picture element location. Toner deposits onto to the engine pixel location according to the difference of potential therebetween. However, the difference of potential decreases as charged toner transfers to the picture element location. Accordingly, while the net difference of potential at the start of a development step can be high, this net difference of potential decreases as development progresses, slowing the development process and effectively limiting the overall amount of toner developed onto picture element locations of the primary imaging member.

Development efficiency can be characterized as a ratio of a difference of potential between a development station and the engine pixel location during development and a difference of potential between development station and the toned pixel. Development efficiency limitations can be particularly noticeable when the difference of potential between a development station and the charge at the engine pixel location being developed is relatively low or where development efficiency varies during development of an image. Further, in toner images that use multiple layers of color toner, there can be significant differences in the development efficiencies for each layer of toner applied. These development efficiency differences can exacerbate relief differences that already exist between large toner piles formed in high difference of potential areas and comparatively low difference of potential areas that will have low toner stack heights.

Various schemes are known in the art to provide improved development efficiency. These typically seek to improve the development efficiency of a single toner by positioning multiple development stations along a primary imaging member in order to present the same toner to the same portions of a primary imaging member multiple times effectively increasing the amount of time during which development can occur and allowing full development at lower potentials. The overall development efficiencies of each color separation will be closer to a desired development efficiency. Examples of such methods include U.S. Pat. Nos. 3,724,422 issued to Latone et al.; 3,927,641 issued to Handa, 4,041,903 issued to Katakura et al. Such approaches can improve toner development efficiency but are not suitable for the formation of an inverse mask.

What are needed therefore are new methods and apparatuses for applying an inverse masking toner to toner stacks formed from one or more color separation toners forming a toner image in amounts that vary inversely with the amount of color separation toner in the toner stacks to form an exterior surface of the fused toner image that has a more uniform index of refraction and reduced relief differentials. Another need in the art is for methods and apparatuses to be provided that allow application of inverse masking toner to compensate for development efficiency limitations. Still another need in the art is for methods and apparatuses to be provided that allow the formation of such an inverse mask toner without requiring calculation of second toner amounts based on analysis of color separation data, without requiring an image printing module to selectively position the inverse masking toner relative to the toner stacks or to adjustably control the amount of inverse mask toner applied to particular toner stacks.

What are needed therefore are new methods for providing a protective and gloss improving toner to toner stacks formed from one or more color separation toners to form an exterior surface of the fused toner image that has a more uniform index of refraction and reduced relief differentials. Another need in the art is for methods to be provided that allow for such a protective and gloss improving toner to provide some compensation for development efficiency limitations.

Still another need in the art is for methods to be provided that allow the application of such a protective and gloss improving toner in specific amounts on specific toner stacks in toned portions of a receiver. Prior art requires precise registration with the toner stacks formed in the color toner image. Even minor mis-registration can yield highly unpredictable results that can increase relief differentials and decrease rather than increase gloss.

Yet another need in the art is for methods to be provided that allow the application of gloss improving toner to reduce relief differentials without requiring calculation of toner amounts based on analysis of color separation data, without requiring an image printing module to selectively position the gloss improving or protective toner relative to the toner stacks or to adjustably control the amount of protective and gloss improving toner applied to particular toner stacks.

SUMMARY OF THE INVENTION

Methods for printing are provided. In one aspect selected engine pixel locations on a primary imaging member are charged with an image modulated difference of potential of a first polarity between a higher potential and a lower potential relative to a ground and a first development difference of potential is established between the higher potential and the lower potential at a first development station to form a first net development difference of potential between the first development station and individual engine pixel locations on the primary imaging member with the first net development potential being the first development difference of potential less any image modulated difference of potential at the engine pixel location. A first toner charged at the first polarity is positioned at the first development station such that the first toner is electrostatically urged to deposit in the individual engine pixel locations according to the first net development difference of potential for the individual engine pixel locations. A second development difference of potential of the first polarity is established at a second development station to form a second net development difference of potential between the second development station and individual engine pixel locations on the primary imaging member, with the second net development difference of potential being the second development difference of potential less any image modulated difference of potential at the individual engine pixel location and less any difference of potential relative to ground of any first toner at the individual engine pixel location. A second toner having a charge of the first polarity is positioned at the second development station such that the second toner is electrostatically urged by the second net development difference of potential to deposit on engine pixel locations having first toner. The second development difference of potential is greater than the first development difference of potential to cause the second toner to deposit on the engine pixel locations having first toner in an amount that increases monotonically according to the second net development difference of potential.

DETAILED DESCRIPTION OF THE DRAWINGS

Figure 6:
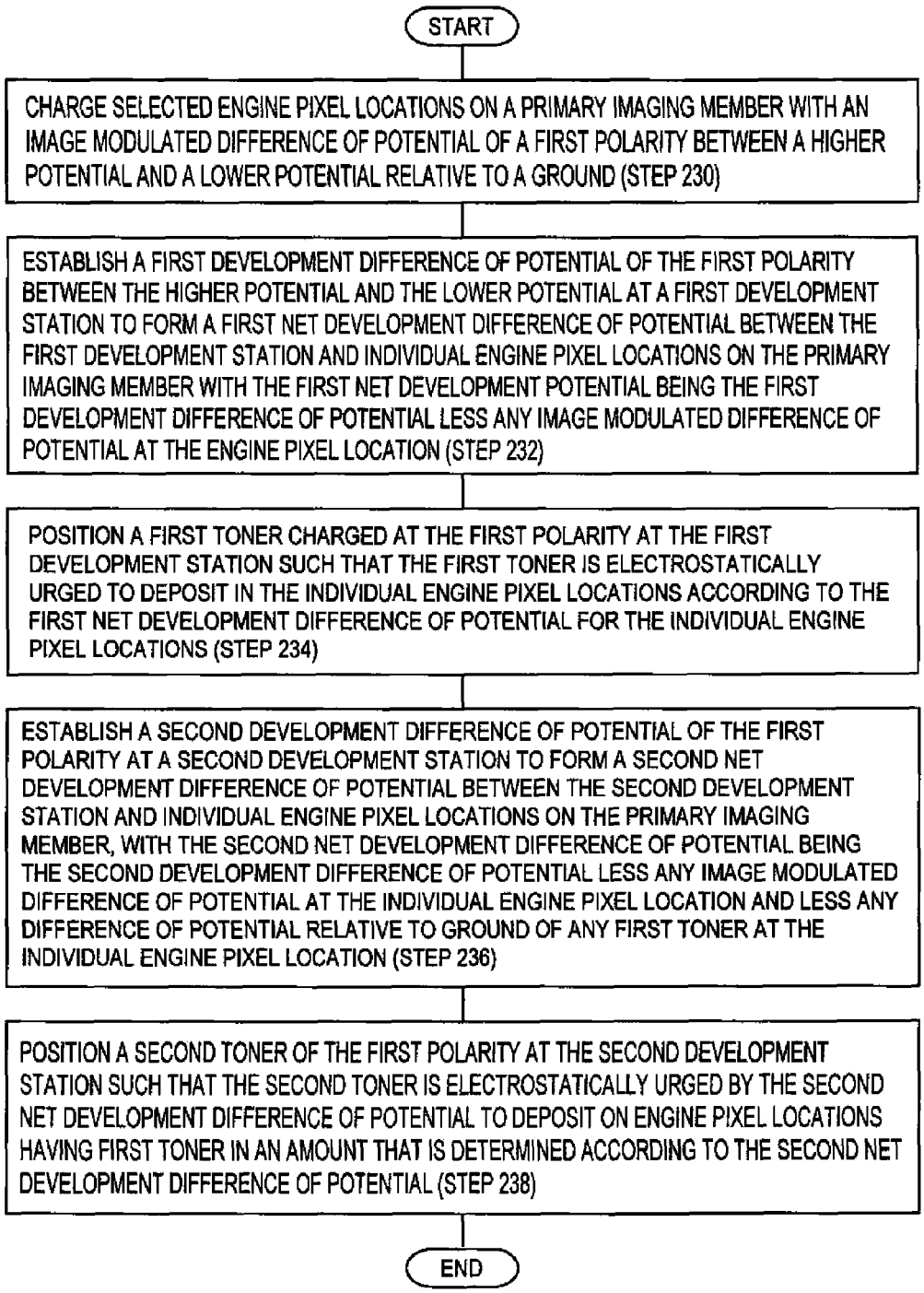
FIG. 6 shows a first embodiment of a printing method.
Figure 7A:
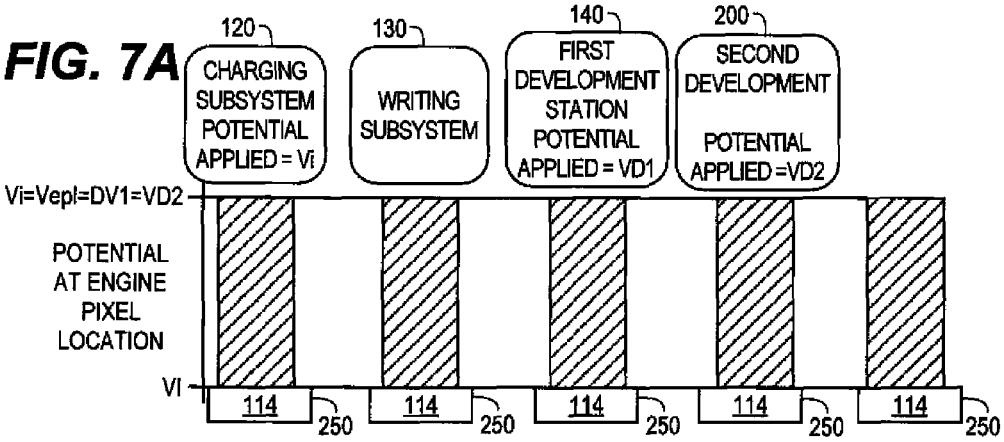
Figure 7B:
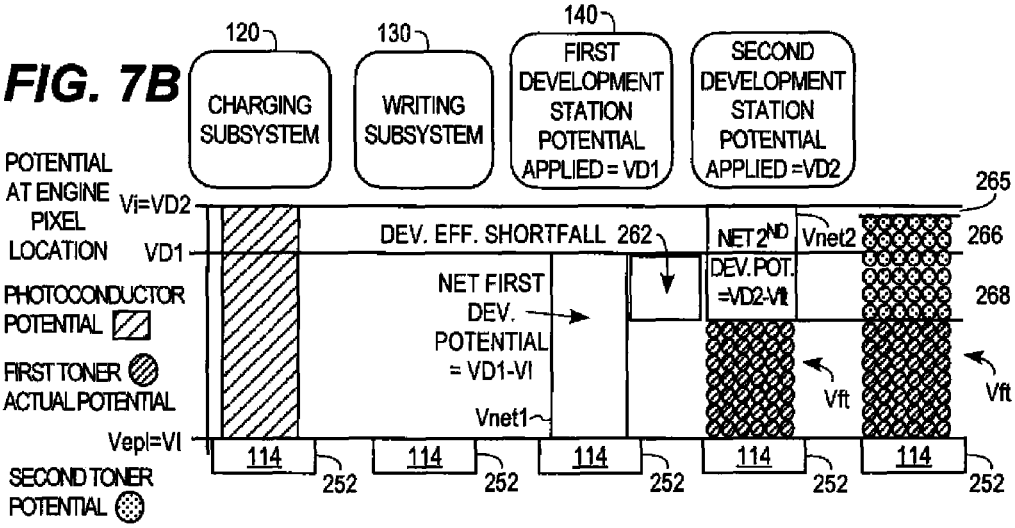
Figure 7C:
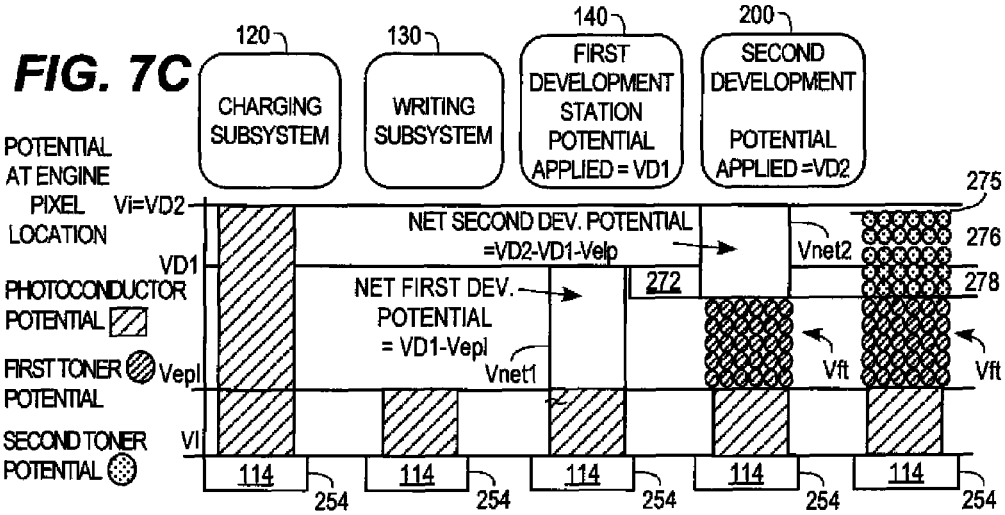

FIGS. 7A-7C provide illustrations depicting the operation of the method of FIG. 6 to provide at a toner overcoat on toned portions of receiver.

Figure 8A:
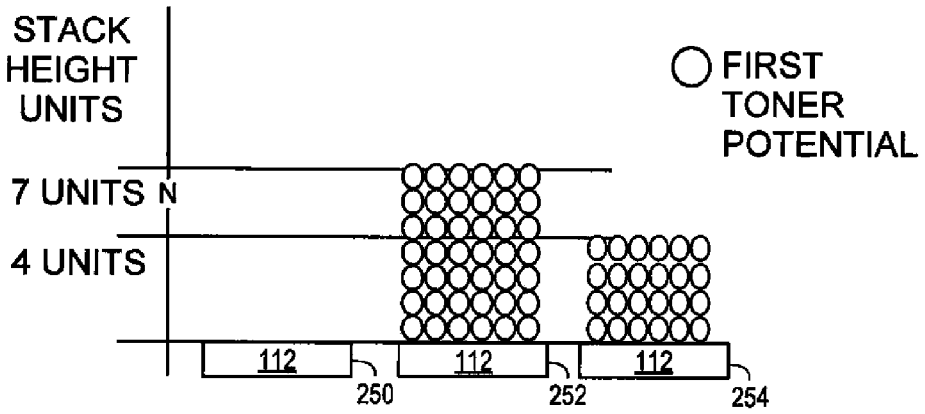
Figure 8B:
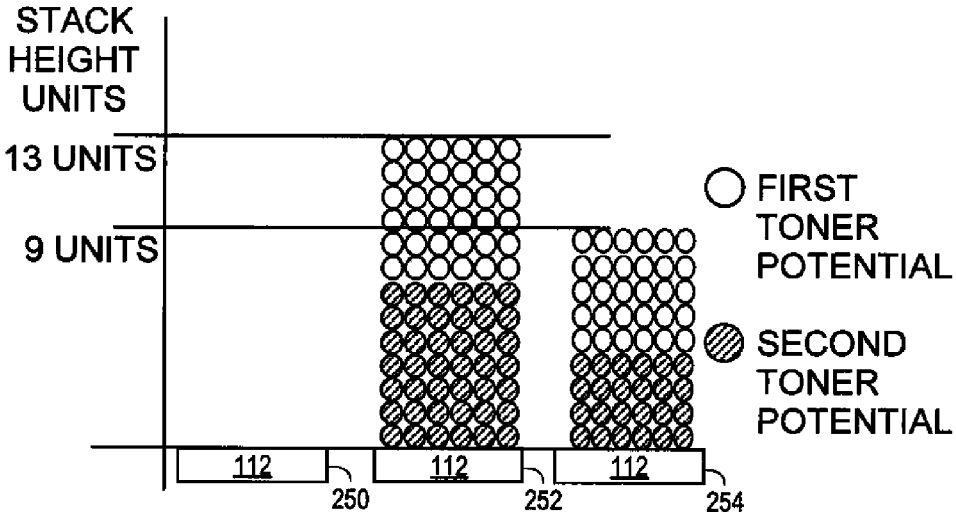

FIGS. 8A-8B illustrate toner stack height enhancement effects of the method of FIG. 6 at different engine pixel locations.

Figure 9A:
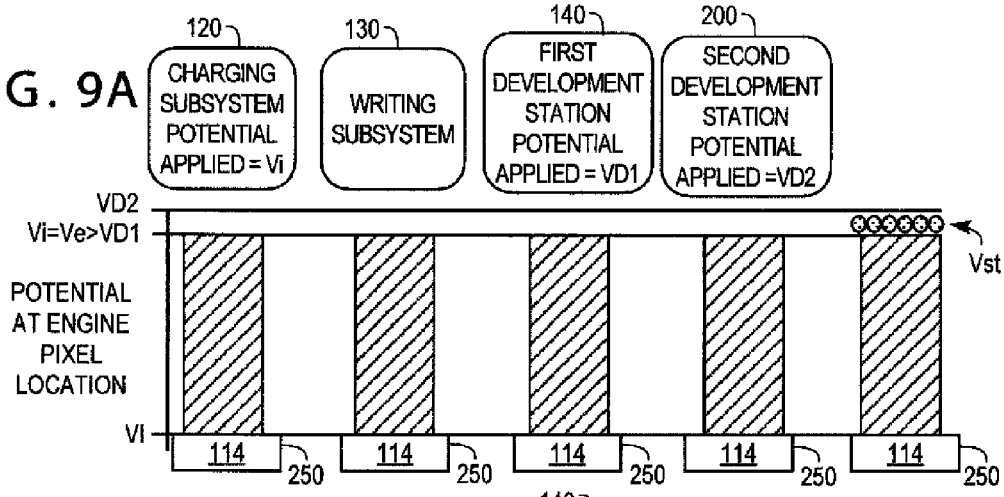
Figure 9B:
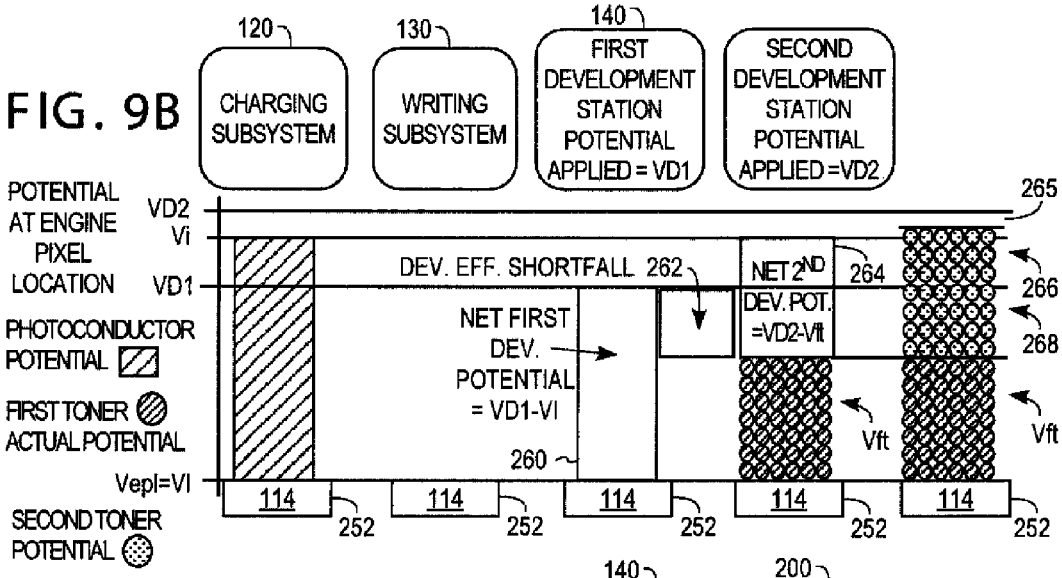
Figure 9C:
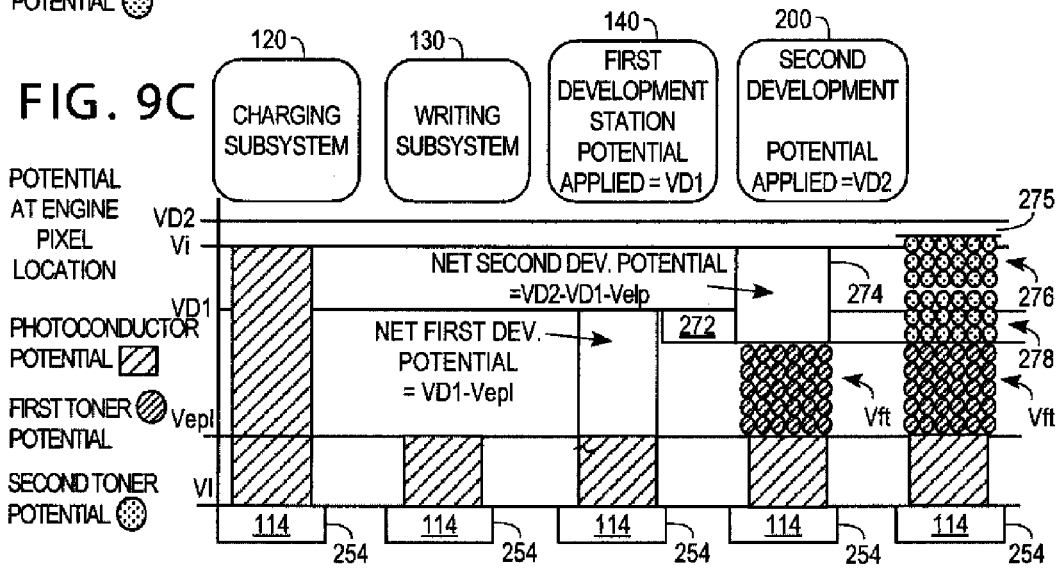

FIGS. 9A-9C provide illustrations depicting the operation of the method of FIG. 6 to provide a toner overcoat across both toned and untoned portions of a receiver.

DETAILED DESCRIPTION OF THE INVENTION

Figure 1:
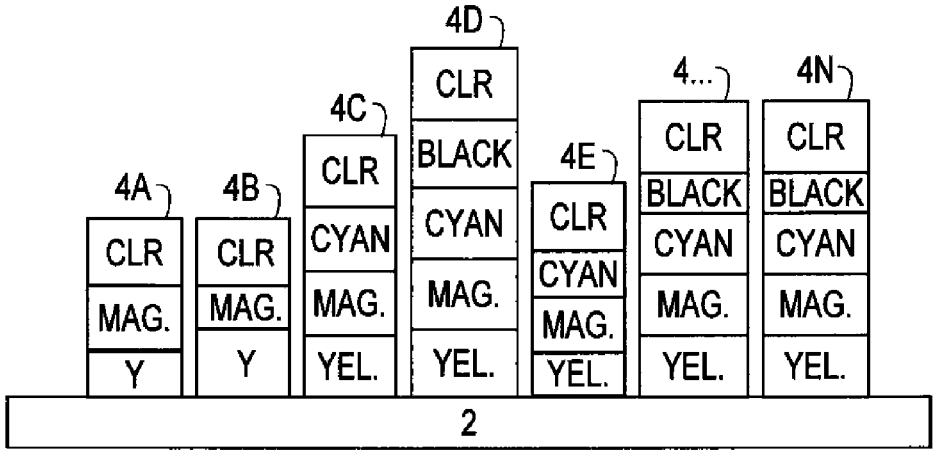
FIG. 1 (PRIOR ART)
FIG. 1 shows a plurality of color toner stacks on a receiver.
Figure 2:
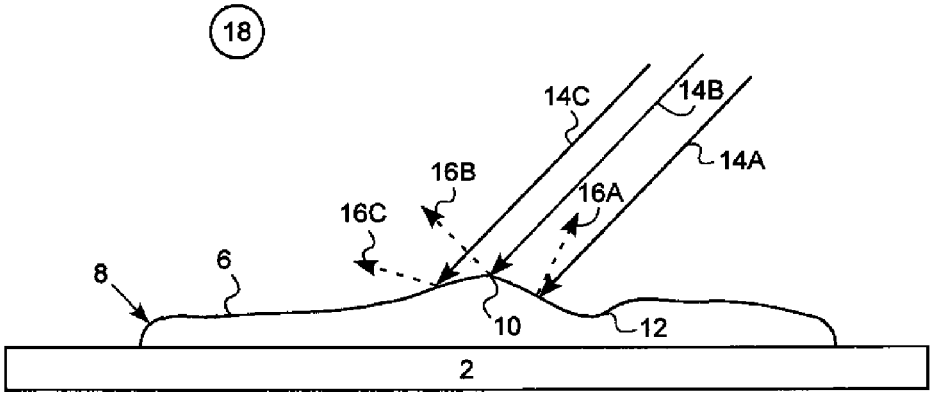
FIG. 2 (PRIOR ART)
FIG. 2 shows the toner stacks of FIG. 1 in a fused state.
Figure 3:
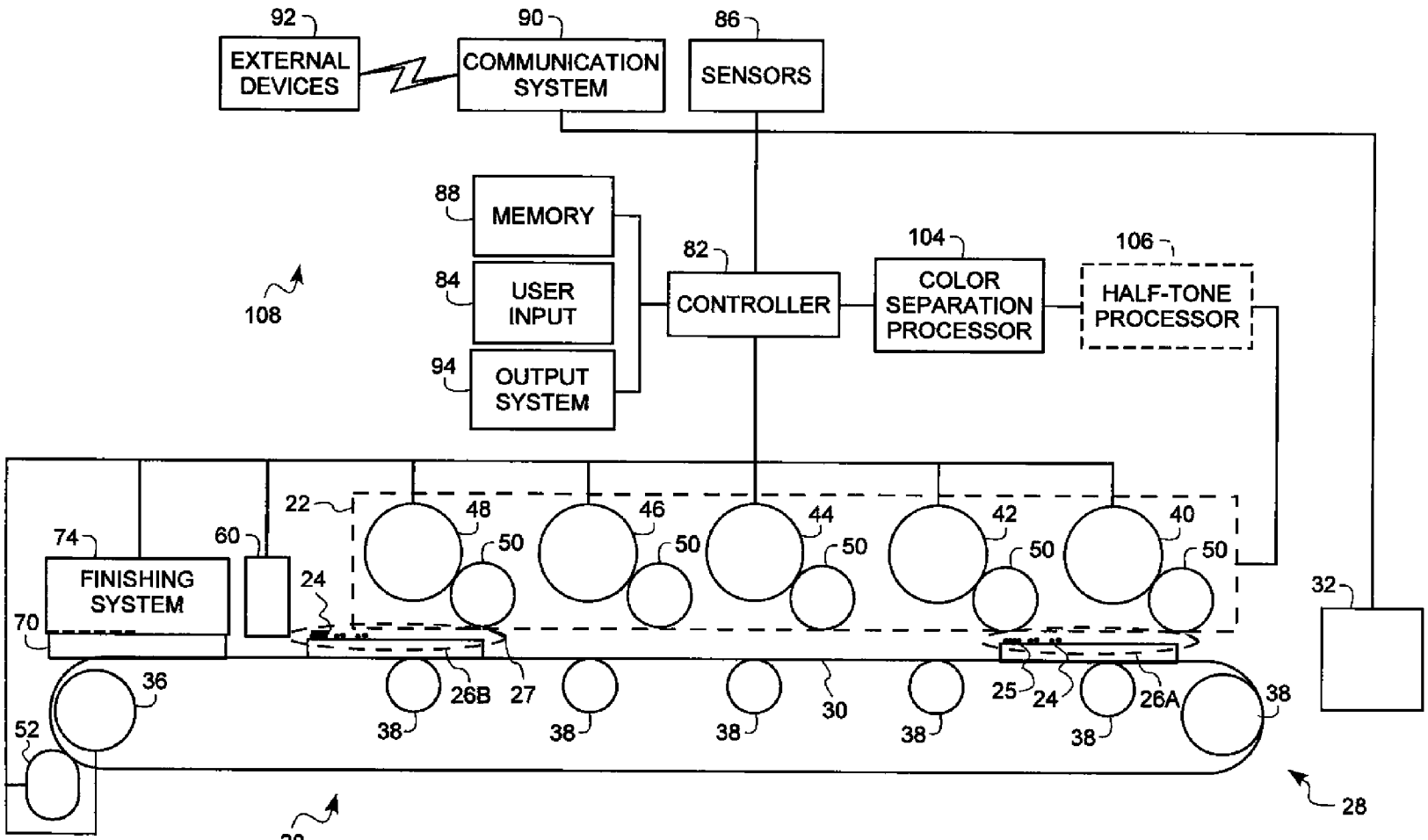
FIG. 3 shows a system level illustration of one embodiment of an electrophotographic printer.

FIG. 3 is a system level illustration of a printer 20. In the embodiment of FIG. 3, printer 20 has a print engine 22 of an electrophotographic type that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles and that can form an image, pattern, or indicia when electrostatically deposited on an imaging member including a photoreceptor, photoconductor, electrostatically-charged, or magnetic surface. As used herein, "toner particles" are the particles that are electrostatically transferred by print engine 22 to form a pattern of material on a receiver 26A to convert an electrostatic latent image into a visible image or other pattern of toner 24 on receiver. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26A.

Toner particles can have a range of diameters, e.g. less than 4 μm, on the order of 5-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink. In certain embodiments, toner 24 can also comprise particles that are entrained in a liquid carrier.

Typically, receiver 26A, 26B takes the form of paper, film, fabric, metallicized or metallic sheets or webs. However, receiver 26A, 26B can take any number of forms and can comprise, in general, any article or structure that can be moved relative to print engine 22 and processed as described herein.

Print engine 22 has one or more printing modules, shown in FIG. 3 as printing modules 40, 42, 44, 46, and 48 that are each used to deliver a single application of toner 24 to form a toner image 25 on receiver 26A, 26B. For example, the toner image 25 shown formed on receiver 26A in FIG. 3 can provide a monochrome image or layer of a structure or other functional material or shape.

Print engine 22 and a receiver transport system 28 cooperate to deliver one or more toner image 25 in registration to form a composite toner image 27 such as the one shown formed in FIG. 3 as being formed on receiver 26B. Composite toner image 27 can be used for any of a plurality of purposes, the most common of which is to provide a printed image with more than one color. For example, in a four color image, four toner images are formed each toner image having one of the four subtractive primary colors, cyan, magenta, yellow, and black. These four color toners can be combined to form a representative spectrum of colors. Similarly, in a five color image various combinations of any of five differently colored toners can be combined to form a color print on receiver 26A, 26B. That is, any of the five colors of toner 24 can be combined with toner 24 of one or more of the other colors at a particular location on receiver 26A, 26B to form a color after a fusing or fixing process that is different than the colors of the toners 24 applied at that location.

In FIG. 3, print engine 22 is illustrated as having an optional arrangement of five printing modules 40, 42, 44, 46, and 48, also known as electrophotographic imaging subsystems arranged along a length of receiver transport system 28. Each printing module delivers a single toner image 25 to a respective transfer subsystem 50 in accordance with a desired pattern. The respective transfer subsystem 50 transfers the toner image 25 onto a receiver 26A, 26B as receiver 26A, 26B is moved by receiver transport system 28. Receiver transport system 28 comprises a movable surface 30 that positions receiver 26A, 26B relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In an alternate embodiment, not shown, printing modules 40, 42, 44, 46 and 48 can each deliver a single application of toner 24 to a composite transfer subsystem 50 to form a combination toner image thereon which can be transferred to a receiver Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26A, 26B or an intermediate in order to yield a composite toner image 27 on receiver 26A, 26B and to cause fuser 60 to fuse composite toner image 27 on receiver 26A, 26B to form a print 70 as described herein or otherwise known in the art.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, fusing, finishing or other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions from a variety of sources. In the embodiment of FIG. 3, these sources include memory 88, communication system 90, that printer 20 can receive such image data through local generation or processing that can be executed at printer 20 using, for example, user input system 84, output system 94 and printer controller 82. Print order information can also be generated by way of remote input 56 and local input 66 and can be calculated by printer controller 82. For convenience, these sources are referred to collectively herein as source of print order information 108. It will be appreciated, that this is not limiting and that source of print order information 108 can comprise any electronic, magnetic, optical or other system known in the art of printing that can be incorporated into printer 20 or that can cooperate with printer 20 to make print order information or parts thereof available.

In the embodiment of printer 20 that is illustrated in FIG. 3, printer controller 82 has a color separation image processor 104 to convert the image data into color separation images that can be used by printing modules 40-48 of print engine 22 to generate toner images. An optional half-tone processor 106 is also shown that can process the color separation images according to any half-tone screening requirements of print engine 22.

Figure 4A:
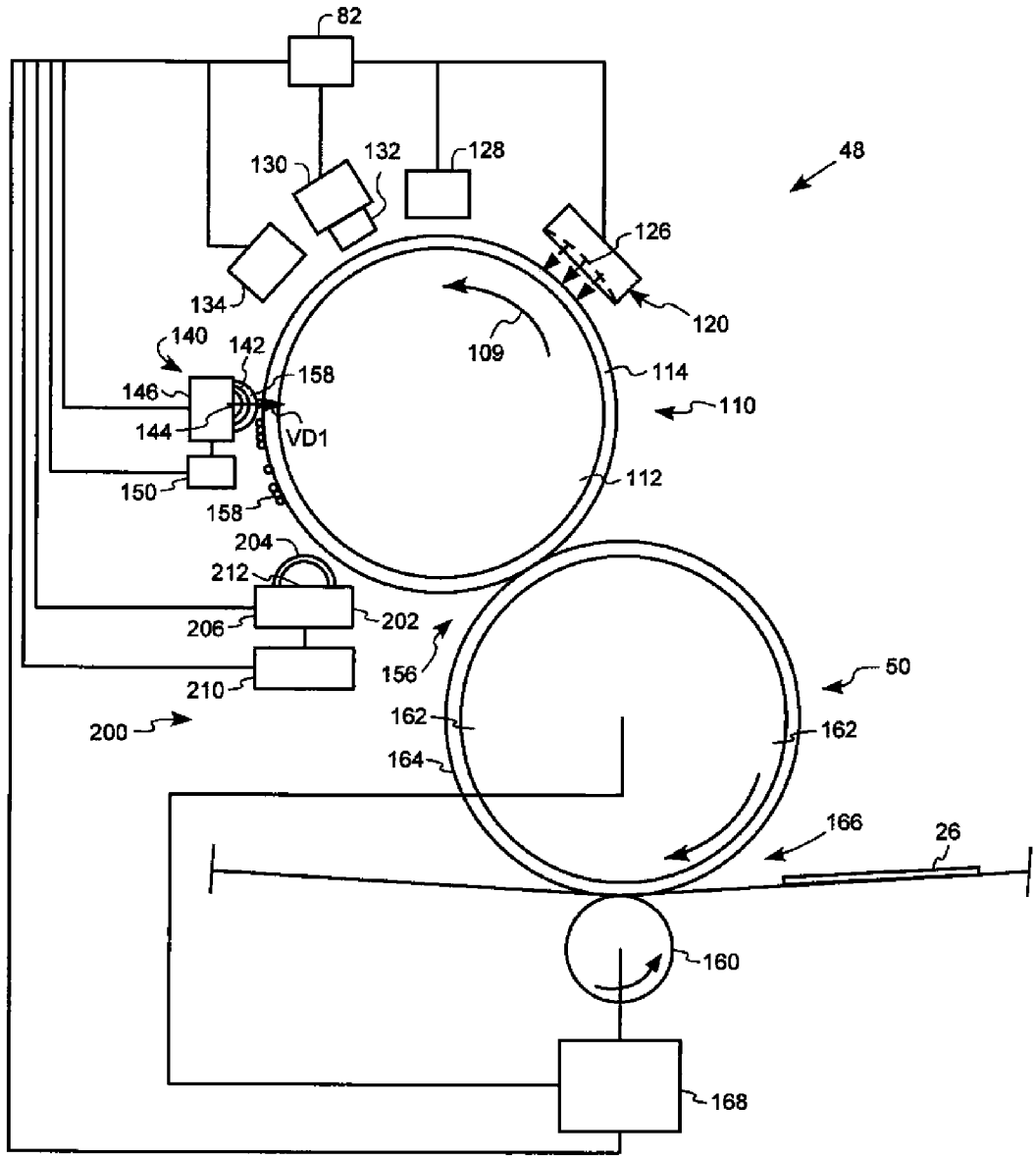
FIG. 4A-4C illustrates a printing module.
Figure 4B:
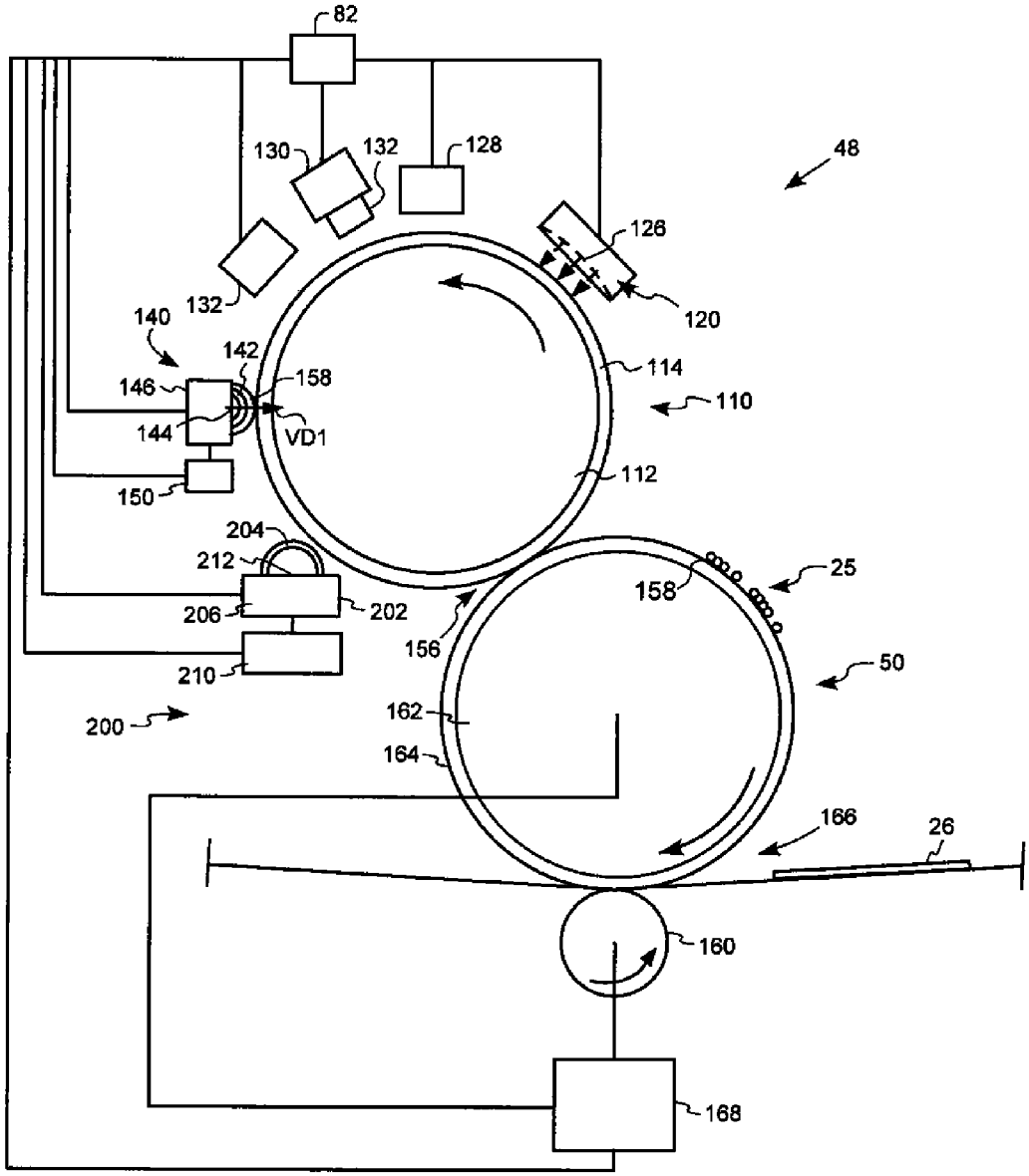
Figure 4C:
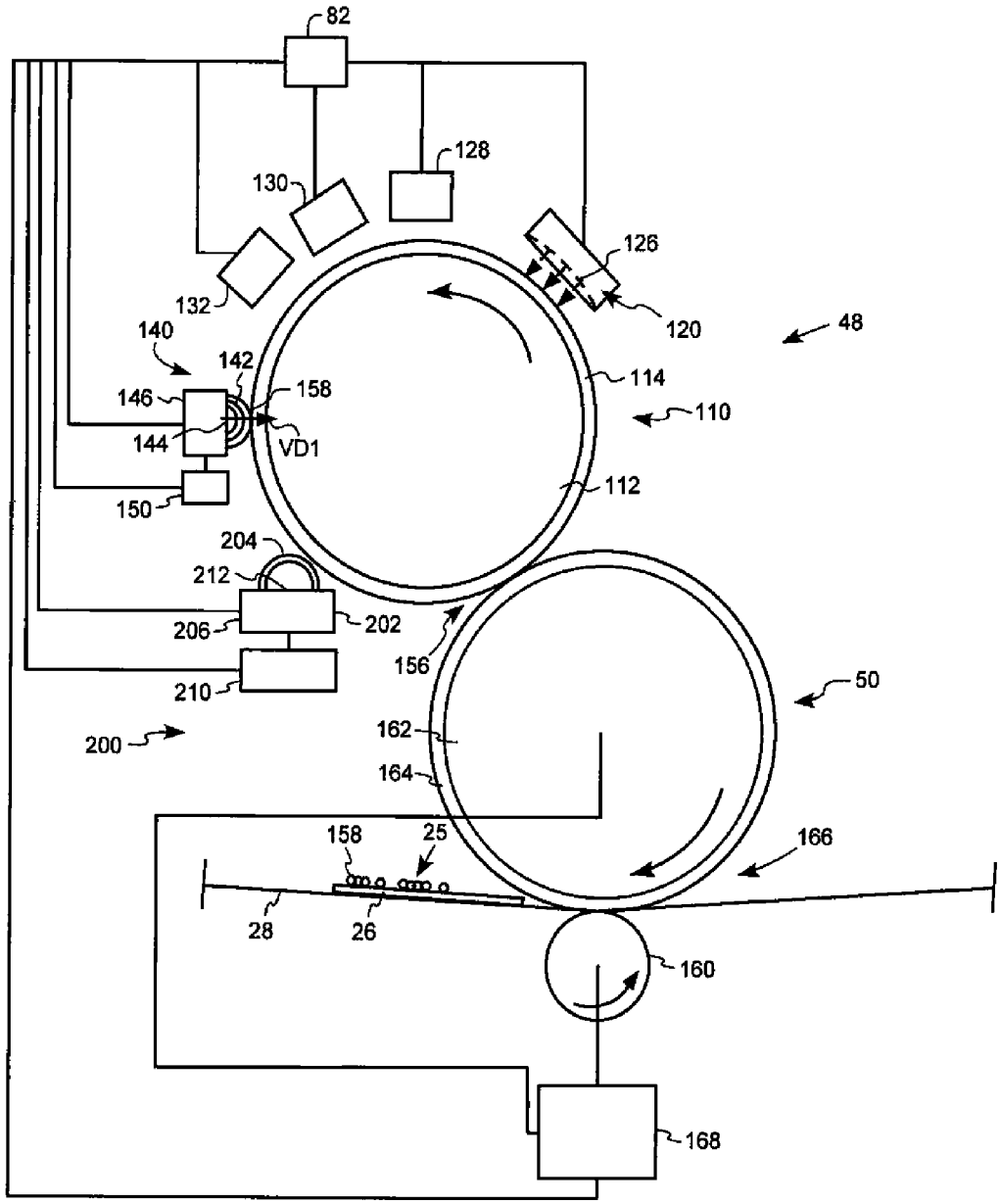

FIGS. 4A-4C shows more details of an example of a printing module 48 representative of printing modules 40, 42, 44, and 46 of FIG. 3. In this embodiment, printing module 48 has a primary imaging system 110, a charging subsystem 120, a writing subsystem 130, a first development station 140 and a second development system 200 that are each ultimately responsive to printer controller 82. Each printing module can also have its own respective local controller (not shown) or hardwired control circuits (not shown) to perform local control and feedback functions for an individual module or for a subset of the printing modules. Such local controllers or local hardwired control circuits are coupled to printer controller 82.

Primary imaging system 110 includes a primary imaging member 112. In the embodiment of FIGS. 4A-4C, primary imaging member 112 takes the form of an imaging cylinder. However, in other embodiments primary imaging member 112 can take other forms, such as a belt or plate. As is indicated by arrow 109 in FIGS. 4A-4C, primary imaging member 112 is rotated by a motor (not shown) such that primary imaging member 112 rotates from charging subsystem 120, to writing subsystem 13Q to first development station 140 and into a transfer nip 156 with a transfer subsystem 50.

In the embodiment of FIGS. 4A-4C, primary imaging member 112 has a photoreceptor 114. Photoreceptor 114 includes a photoconductive layer formed on an electrically conductive substrate. The photoconductive layer is an insulator in the substantial absence of light so that initial differences of potential Vi can be retained on its surface. Upon exposure to light, the charge of the photoreceptor in the exposed area is dissipated in whole or in part as a function of the amount of the exposure. In various embodiments, photoreceptor 114 is part of, or disposed over, the surface of primary imaging member 112. Photoreceptor layers can include a homogeneous layer of a single material such as vitreous selenium or a composite layer containing a photoconductor and another material. Photoreceptor layers can also contain multiple layers.

Charging subsystem 120 is configured as is known in the art, to apply charge to photoreceptor 114. The charge applied by charging subsystem 120 creates a generally uniform initial difference of potential Vepl relative to ground. The initial difference of potential Vepl has a first polarity which can, for example, be a negative polarity. Here, charging subsystem 120 includes a grid 126 that is selected and driven by a power source (not shown) to charge photoreceptor 114. Other charging systems can also be used.

In this embodiment, an optional meter 128 is provided that measures the electrostatic charge on photoreceptor 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential Vi on photoreceptor 114. In other embodiments, a local controller or analog feedback circuit or the like can be used for this purpose.

Writing subsystem 130 is provided having a writer 132 that forms charge patterns on a primary imaging member 112. In this embodiment, this is done by exposing primary imaging member 112 to electromagnetic or other radiation that is modulated according to color separation image data to form a latent electrostatic image (e.g., of a color separation corresponding to the color of toner deposited at printing module 48) and that causes primary imaging member 112 to have image modulated charge patterns thereon.

In the embodiment shown in FIGS. 4A-4C, writing system 130 exposes the uniformly-charged photoreceptor 114 of primary imaging member 112 to actinic radiation provided by selectively activating particular light sources in an LED array or a laser device outputting light directed at photoreceptor 114. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time. While various embodiments described herein describe the formation of an imagewise modulated charge pattern on a primary imaging member 112 by using a photoreceptor 114 and optical type writing subsystem 130, such embodiments are exemplary and any other system method or apparatuses known in the art for forming an imagewise modulated pattern differences of potential on a primary imaging member 112 consistent with what is described or claimed herein can be used for this purpose.

As used herein, an "engine pixel" is the smallest addressable unit of primary imaging system 110 or in this embodiment on photoreceptor 114 which writer 132 (e.g., a light source, laser or LED) can expose with a selected exposure different from the exposure of another engine pixel. Engine pixels can overlap, e.g., to increase addressability in the slow-scan direction (S). Each engine pixel has a corresponding engine pixel location on an image and the exposure applied to the engine pixel location is described by an engine pixel level. The engine pixel level is determined based upon the density of the color separation image being printed by printing module 48.

Writing subsystem 130 is a write-black or discharged-area development (DAD) system where image wise modulation of the primary imaging member 112 is performed according to a model under which a toner is charged to have the same first polarity as the charge on primary imaging member 112. As is used herein difference of potential refers to a difference of potential between the cited member and ground unless otherwise specified as the difference of potential between two members. In the DAD system, the charged toner is urged to primary imaging member 112 by a net difference of potential between a first development station 140 and the individual engine pixel locations on the primary imaging member 112 during development. In the embodiment of FIGS. 4A-4C this difference of potential varies based on the difference of potential at each engine pixel location Vepl. Toner of the first potential is urged to deposit onto engine pixel locations on the primary imaging member 112 where the difference of potential of an engine pixel location Vepl of primary imaging member 112 has been modulated from the initial difference of potential Vi to a lower level. The magnitude of the difference of potential an engine pixel location Vepl inversely corresponds to the engine pixel level for the engine pixel location.

Accordingly, in a DAD system, toner develops on the primary imaging member 112 at engine pixel locations that have a difference of potential Vepl that is lower than a development difference of potential and does not develop on the primary imaging member 112 at locations that have a difference of potential Vepl that is greater than a development difference of potential used to develop a toner at these engine pixel locations. It will be appreciated that in this regard, any or all of printer controller 82, color separation processor 104 and half tone processor 106 process image information and printing instructions in ways that cause image modulated differences of potential to be generated according to this DAD model.

Engine pixel locations having an image modulated difference of potential that is less than the initial difference of potential Vi therefore correspond to areas of primary imaging member 112 onto which toner will be deposited during development while areas having an image modulated potential that is above the development difference of potential are not developed with toner.

After writing, primary imaging member 112 has an image modulated difference of potential at each engine pixel location Vepl that varies between a higher difference potential Vh that can be at the initial difference of potential Vi reflecting in this embodiment, a difference of potential at an engine pixel location that has not been exposed, and that can be above a lower level Vl reflecting in this embodiment a lower difference of potential at an engine pixel location that has been exposed by an exposure at an upper range of available exposure settings.

Another meter 134 is optionally provided in this embodiment and measures charge within a non-image test patch area of photoreceptor 114 after the photoreceptor 114 has been exposed to writer 132 to provide feedback related to differences of potential created using writer 132 and photoreceptor 114. Other meters and components (not shown) can be included to monitor and provide feedback regarding the operation of other systems described herein so that appropriate control can be provided.

First development station 140 has a first toning shell 142 that provides a first developer having a first toner 158 near primary imaging member 112. First toner 158 is charged and has the same polarity as the initial charge Vi on primary imaging member 112 and as any image modulated potential Vepl of the engine pixel locations on primary imaging member 112. First development station 140 also has a first supply system 146 for providing charged first toner 158 to first toning shell 142 and a first power supply 150 for providing a bias for first toning shell 142. First supply system 146 can be of any design that maintains or that provides appropriate levels of charged first toner 158 at first toning shell 142 during development. Similarly, first power supply 150 can be of any design that can maintain the bias described herein. In the embodiment illustrated here, first power supply 150 is shown optionally connected to printer controller 82 which can be used to control the operation of first power supply 150.

The bias at first toning shell 142 creates a first development difference of potential VD1 of the first polarity relative to ground. The first development difference of potential VD1 forms a first net development difference of potential Vnet1 between first toning shell 142 and individual engine pixel locations on primary imaging member 112. The first net development difference of potential Vnet1 is the first development difference of potential VD1 less any image modulated difference of potential Vepl at the engine pixel location.

First toner 158 on first toning shell 142 develops on individual engine pixel locations of primary imaging member 112 in amounts according to the first net development potential Vnet1. These amounts can, for example, increase along with increases in the first net development difference of potential Vnet1 for each individual engine pixel location and such increases can occur monotonically with increases in the first net development difference of potential Vnet1. Such development produces a first toner image 25 on primary imaging member 112 having first toner quantities associated with the engine pixel locations that correspond to the engine pixel levels for the engine pixel locations.

The electrostatic forces that cause first toner 158 to deposit onto primary imaging member 112 can include Coulombic forces between charged toner particles and the charged electrostatic latent image, and Lorentz forces on the charged toner particles due to the electric field produced by the bias voltages.

In one example embodiment, first development station 140 employs a two-component developer that includes toner particles and magnetic carrier particles. In this embodiment, first development station 140 includes a magnetic core 144 to cause the magnetic carrier particles near first toning shell 142 to form a "magnetic brush," as known in the electrophotographic art. Magnetic core 144 can be stationary or rotating, and can rotate with a speed and direction the same as or different than the speed and direction of first toning shell 142. Magnetic core 144 can be cylindrical or non-cylindrical, and can include a single magnet or a plurality of magnets or magnetic poles disposed around the circumference of magnetic core 144. Alternatively, magnetic core 144 can include an array of solenoids driven to provide a magnetic field of alternating direction. Magnetic core 144 preferably provides a magnetic field of varying magnitude and direction around the outer circumference of first toning shell 142. Further details of magnetic core 144 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. In other embodiments, first development station 140 can also employ a mono-component developer comprising toner, either magnetic or non-magnetic, without separate magnetic carrier particles. In further embodiments, first development station 140 can take other known forms that can perform development in any manner that is consistent with what is described and claimed herein.

As is shown in FIG. 4B, in this embodiment, after a first toner image 25 is formed, rotation of primary imaging member 112 causes first toner image 25 to move past second development system 200 which is not shown as being active in FIGS. 4A-4C, and into a first transfer nip 156 between primary imaging member 112 and a transfer subsystem 50. As shown in FIG. 4B, in this embodiment transfer subsystem 50 has an intermediate transfer member 162 that receives toner image 25 at first transfer nip 156. As is shown in FIG. 4C, intermediate transfer member 162 then rotates to move first toner image 25 to a second transfer nip 166 where a receiver 26 receives first toner image 25. In this embodiment, transfer subsystem 50 includes transfer backup member 160 opposite transfer member 162 at second transfer nip 166. Receiver transport system 28 passes at least in part through transfer nip 166 to position receiver 26 to receive toner image 25. In this embodiment, intermediate transfer member 162 is shown having an optional compliant transfer surface 164.

Once that toner image 25 has deposited on primary imaging member 112 or onto intermediate transfer member 162, adhesion forces such as van der Waals forces resist separation of toner image 25 from these members unless another force is provided that overcomes these adhesion forces. In the embodiment of FIG. 4A, the difference of potential Vft of first toner 158 is used to allow such force to be applied to toner image 25 to enable toner image 25 to over come the adhesion forces and to transfer onto intermediate transfer member 162 and later to enable transfer from intermediate transfer member 162 and on to a receiver 26. As is illustrated in the embodiment of FIGS. 4A-4C, a transfer power supply 168 is provided that creates a difference of potential between primary imaging member 112, and a difference of potential between transfer member 162 and transfer backup member 160. These differences in potential are used to cause toner image 25 to transfer from primary imaging member 112 to intermediate transfer member 162 and to transfer from the intermediate transfer member 162 to the receiver 26.

Returning to FIG. 3, it will understood that printer controller 82 causes one or more of individual printing modules 40, 42, 44, 46 and 48 to generate a toner image 25 of a single color of toner for transfer by respective transfer subsystems 50 to receiver 26A, 26B in registration to form a composite toner image 27.

Toner Enhancement System

Figure 5A:
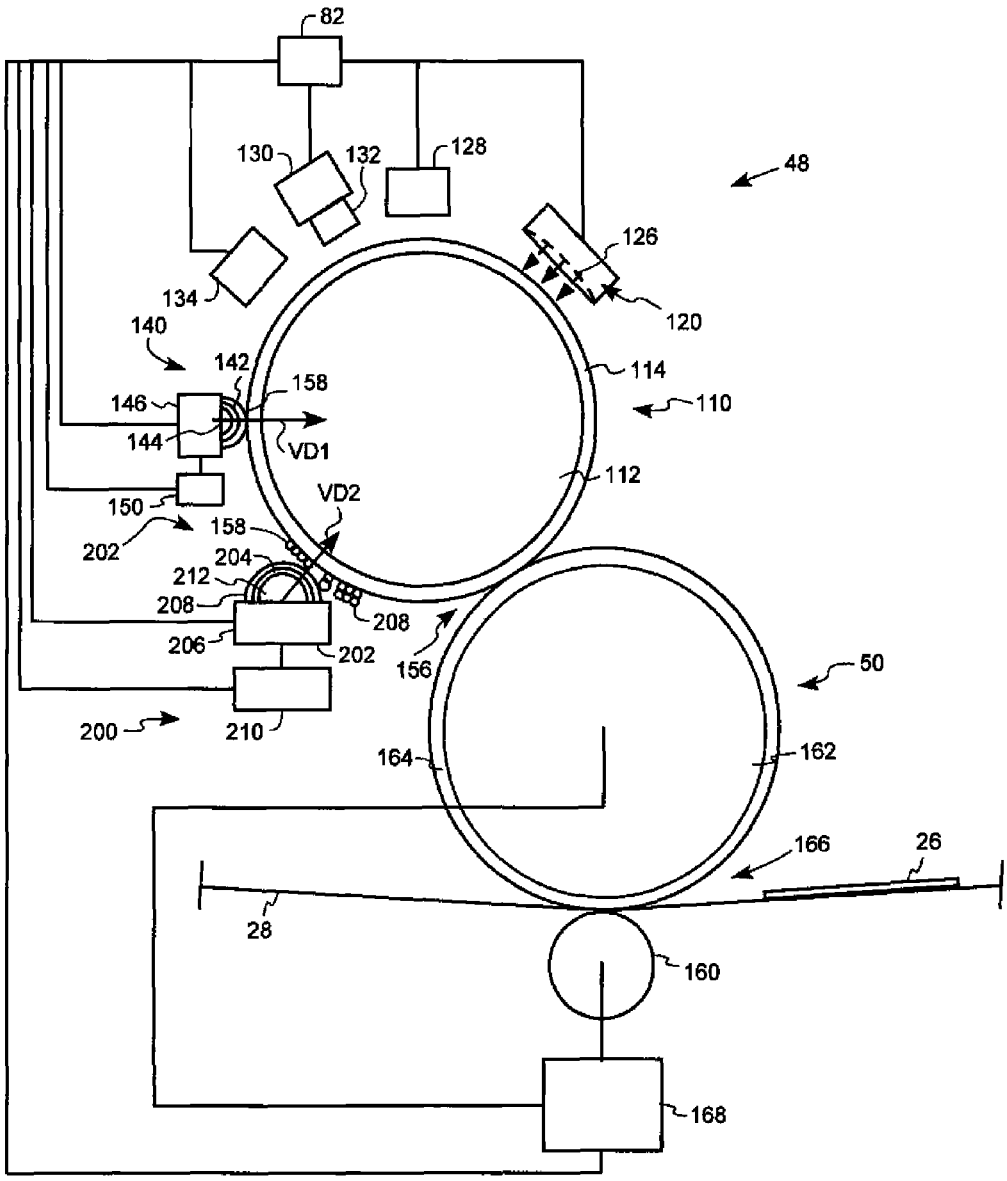
FIGS. 5A-5C shows the operation of relief reduction development system in the embodiment of FIGS. 4A-4C.
Figure 5B:
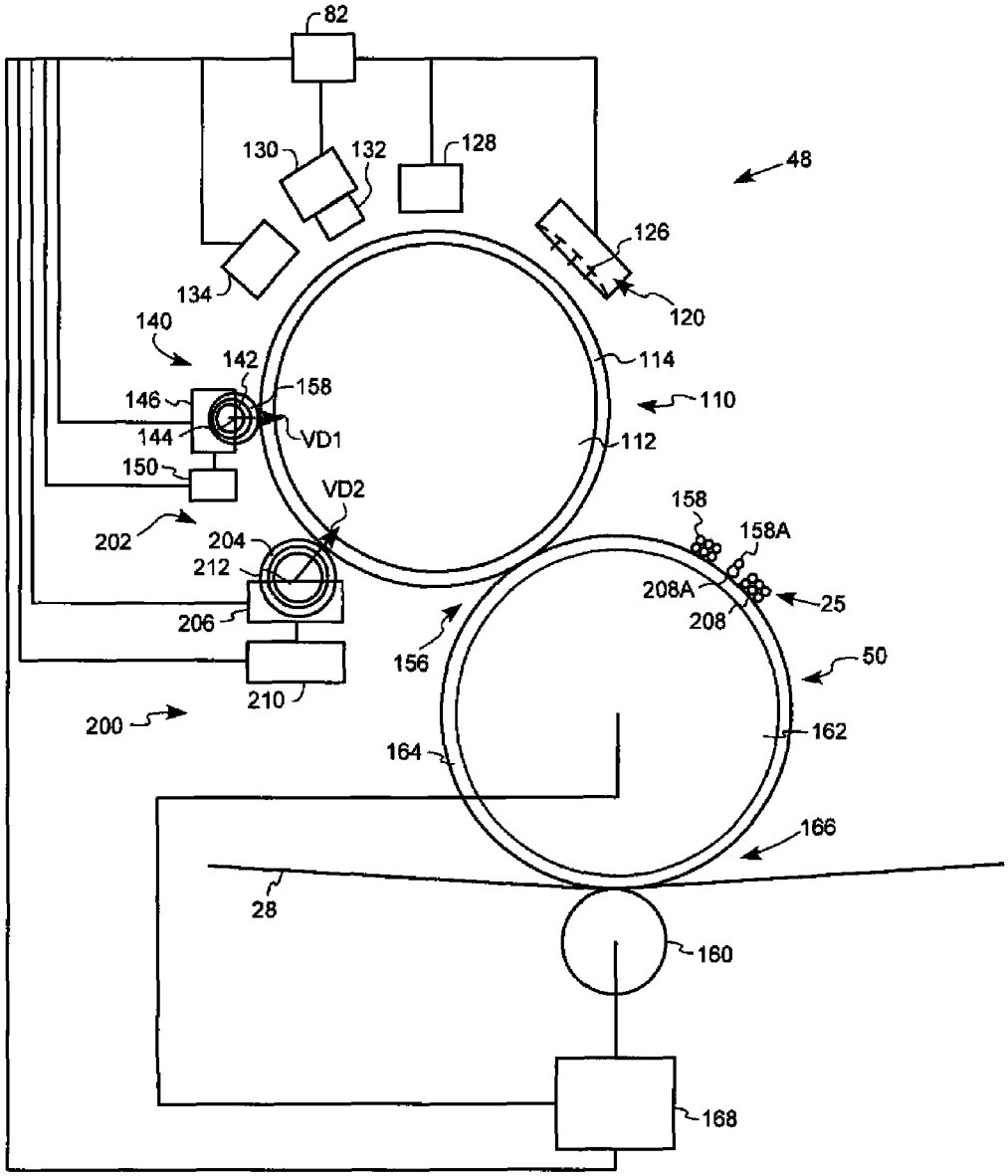
Figure 5C:
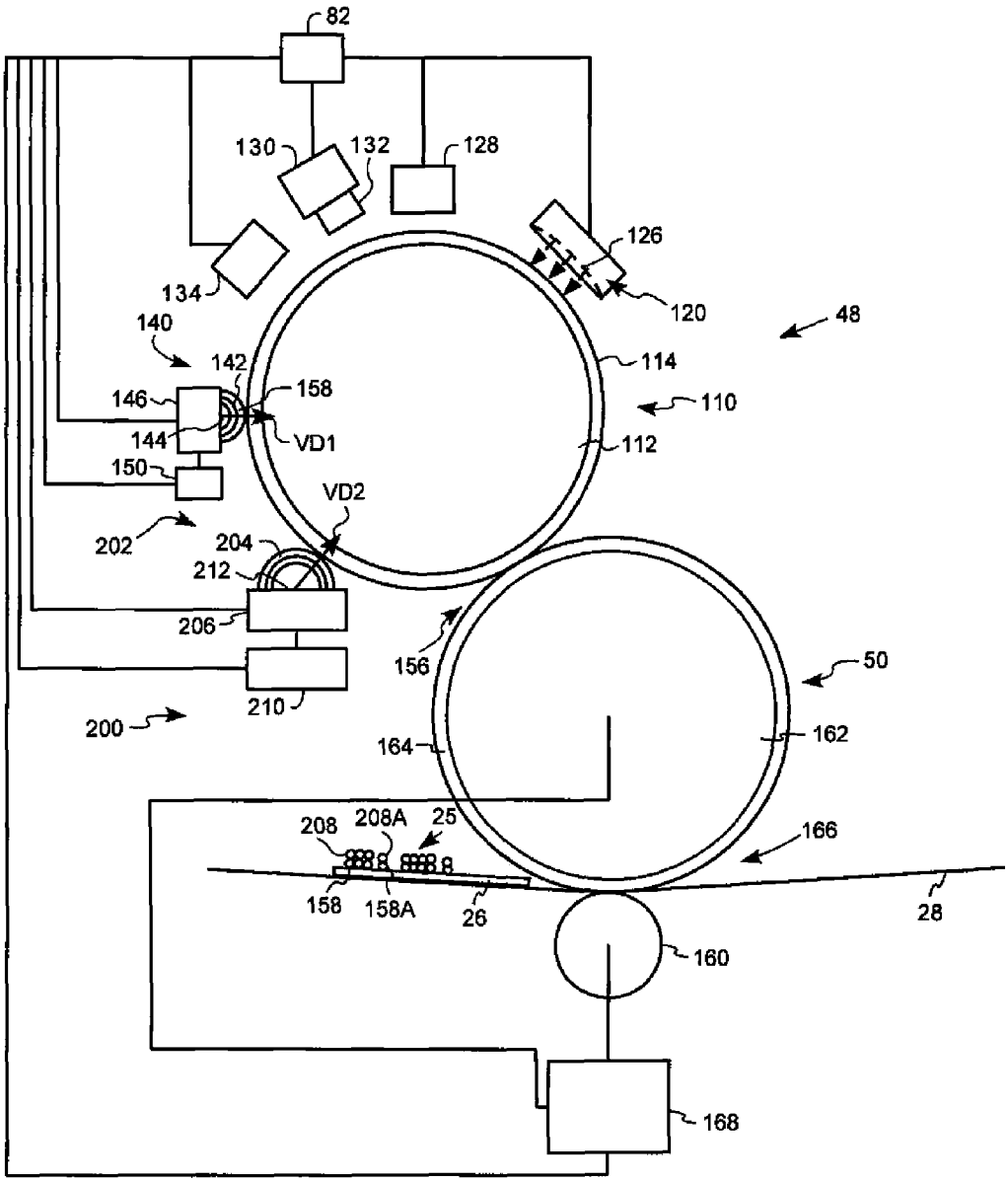

FIGS. 5A-5C illustrate the embodiment of printing module 48 shown in FIGS. 4A-4C, with a toner overcoat system 200 used to provide an overcoat toner for a toner image 25. As is shown in FIG. 5A, toner overcoat system 200 can be incorporated into any of printing modules 40-48 and optionally can be selectively activated by way of signals from printer controller 82.

In this embodiment, toner layer enhancement system 200 has a second development station 202 having a second toning shell 204 that provides a second developer having a second toner 208 near primary imaging member 112. Second toner 208 is charged and has a potential of the same polarity as first toner 158, the initial charge Vi on primary imaging member 112 and any image modulated potential of the engine pixel locations Vepl. Second development station 202 also has a second toner supply system 206 for providing charged second toner 208 of the first polarity to second toning shell 204 and a second power supply 210 that biases second toning shell 204 relative to ground. Second toner supply system 206 can be of any design that maintains or that provides appropriate levels of charged second toner 208 at a second toning shell 204 during development. Similarly, second power supply 210 can be of any design that can maintain the bias described herein on second toning shell 204. In the embodiment illustrated here, second power supply 210 is shown optionally connected to printer controller 82 which can be used to control operation of second power supply 210.

In general, printing modules 40-48 having such a toner overcoat system 200 can be operated as described above to create a first toner image 25 on photoreceptor 114 of primary imaging member 112 as is shown in FIG. 5A.

As is also shown in FIG. 5A, when a bias is applied at a second toning shell 204 a second development difference of potential VD2 is created relative to ground. The second development difference of potential VD2 forms a second net development difference of potential Vnet2 between second toning shell 204, any first toner 158 at the engine pixel location and the image modulated potential Vepl at individual engine pixel locations on primary imaging member 112. The second net development difference of potential Vnet2 is the second development difference of potential VD2 less any image modulated difference potential Vepl at an engine pixel location and less any first toner difference of potential Vft provided by any first toner 158 at the engine pixel location.

Second toner 208 on second toning shell 204 deposits on individual engine pixel locations on primary imaging member 112 in an amount according to the second net development difference of potential Vnet2. This amount can, for example, reflect the difference between first development difference of potential VD1 and second amount second development difference of potential VD2 and that monotonically increases as a function of the net second development difference of potential Vnet2.

The electrostatic forces that cause second toner 208 to deposit onto primary imaging member 112 can include Coulombic forces between charged toner particles and the charged electrostatic latent image, and Lorentz forces on the charged toner particles due to the electric field produced by the bias voltages. Second development station 202 can optionally employ a two-component developer or a one component developer and a magnetic core as described generally above with reference to first development system 140.

As is noted above, first development station 142 can be subject to development efficiency limitations. Accordingly, the first toner difference of potential Vft provided by first toner 158 at a picture element location can be less than the net first development difference of potential Vnet1 created at this picture element location during development of first toner 158. When this occurs, the first toner potential Vft provided by first toner 158 at the engine pixel location plus the image modulated difference of potential at the engine pixel location Vepl are less than the first development difference of potential VD1.

However, when such an engine pixel location is exposed to the second development difference of potential VD2, a net second difference in potential Vnet2 is created that is modulated as a function of the first toner difference of potential Vft at the engine pixel location. This modulation as a function of the first toner difference of potential Vft occurs because the net second development difference of potential Vnet2 increases as compared to what the second net difference of potential Vnet2 would be if a development efficiency of unity had been achieved during development of first toner 158 which would have provided sufficient amounts of charged first toner 158 at each image modulated engine pixel location to form a first toner difference of potential Vft that would have been equal to first net development difference of potential Vnet1. Toner layer enhancement system 200 therefore has the ability to automatically increase the amount of second toner 208 deposited at a picture element location in a manner that is modulated based upon the amount of first toner 158 at the picture element location and therefore increases the amount of second toner 208 developed at an engine pixel location automatically when there is a development efficiency induced shortfall during first development at the engine pixel location. Further because in this embodiment, the second development difference of potential VD2 is greater than the first development difference of potential VD1 a controllable amount of second toner 208 is selectively applied to each of the toner stacks. These effects are conceptually illustrated in FIGS. 5A-5C by the relative sizes of first toner 158*a* and second toner 208*a* at an engine pixel location and this will be discussed and described in greater detail below.

Second toner 208 is different than first toner 158. This can take many forms, in one embodiment, first toner 158 can have first color characteristics while the second toner 208 has different second color characteristics. In one example of this type, first toner 158 can be a toner of a first color having a first hue and second toner 208 can be a toner having the first color and a second different hue.

First toner 158 and second toner 208 can have different material properties. For example, in one embodiment first toner 158 can have a first viscosity and the second toner 158 can have a second viscosity that is different from the first viscosity. In another embodiment, first toner 158 can have a different glass transition temperature than second toner 208. In one example of this type, the second toner 208 can have a lower glass transition temperature than first toner 158. In certain embodiments, second toner 208 can take the form of a toner that is clear, transparent or semi-transparent when fused. In other embodiments, second toner 208 can have finite transmission densities when fused.

First toner 158 and second toner 208 can be differently sized. For example, and without limitation, first toner 158 can comprise toner particles of a size between 4 microns and 9 microns while the second toner 208 can have toner particles of a size between 10 microns and 20 microns or more. First toner 158 and second toner 208 can also have other different properties such as different shapes, can be formed using different processes, or can be provided with additional additives, coatings or other materials known in the art that influence the development, transfer or fusing of toner.

As is shown in FIG. 5B, in this embodiment, after a first toner image 25 having first toner 158 and second toner 208 is formed, rotation of primary imaging member 112 causes first toner image 25 to move into the first transfer nip 156 between primary imaging member 112 and a transfer subsystem 50. As is shown in FIG. 5C, intermediate transfer member 162 then rotates to move first toner image 25 to a second transfer nip 166 where a receiver 26 receives first toner image 25.

In general then a printer 20 having a printing module such as module 48 having a can use toner enhancement system 200 to provide, a second toner 208 on a first toner 158 of a different type in a manner that automatically inversely adapts to an amount of first toner 158 on which the second toner 208 is applied and that automatically and precisely registers second toner 208 with first toner 158 without necessarily being applied to portions of the receiver 26 that are not toned with first toner 158 all without requiring the use of a printing module.

FIG. 6 shows a first embodiment of a method for operating a printer. In a first step of this method, selected engine pixel locations on a primary imaging member 112 are charged to have an image modulated potential of a first polarity, with the image modulated potential being between a lower difference of potential Vl and a higher difference of potential Vh relative to ground (step 230). This can be done, for example, as described above in the printing module 48 of FIGS. 4A-4C, and 5A-5C using charging subsystem 120 and writing system 130 to expose a photoreceptor 114 to selectively release charge on photoreceptor 114. In other embodiments, this step can also be performed using any other charging-writing system that is compatible with a discharge area development process.

A first development difference of potential VD1 of the first polarity is established at first toning shell 142 using, in this example, first power supply 150. The first development difference of potential VD1 is provided in a range between the higher difference of potential Vh and the lower difference of potential Vl. This creates a first net development difference of potential Vnet1 defined by the difference between the first development difference of potential VD1 at first toning shell 142 and the individual image modulated difference of potential Vepl at the engine pixel locations on primary imaging member 112. The first net development difference of potential Vnet1 for an engine pixel location is the first development difference of potential VD1 less any image modulated difference of potential Vepl at the engine pixel location (step 232).

Particles of first toner 158 are charged to the first polarity and positioned between first toning shell 142 and the engine pixel locations so that the first net development difference potential Vnet1 electrostatically urges first toner 158 to deposit first toner 158 at individual engine pixel locations according to the first net development potential Vnet1 for the individual picture element locations (step 234).

A second development difference of potential VD2 of the first polarity is established between second toning shell 204 and ground using for example, second power supply 210. This creates a second net development difference of potential Vnet2 between the second toning shell 204 and the individual engine pixel locations on primary imaging member 112. The second net development difference of potential Vnet2 for the individual image pixel locations is the second development difference of potential VD2, less a difference of potential of the first toner Vft at the individual engine pixel location and the image modulated difference of potential Vepl at the individual engine pixel location. The second development difference of potential VD2 is greater than VD1 in amounts that can range, for example, and without limitation, between about 25 and 50 percent of VD1 (step 236).

Second toner 208 having a charge of the first polarity is positioned so that the second net development potential Vnet2 electrostatically urges second toner 208 to deposit on the engine pixel locations to form a first toner image 25 having second toner 208 at each picture element location in amounts that are modulated by the second net development potential Vnet2 (step 238).

When the second toner 208 is presented, the second development difference of potential VD2 is greater than the first development difference of potential VD1 but less than an initial difference of potential Vi on the primary imaging member 112. This causes at least a first amount of second toner 208 to deposit on individual engine pixel locations having the first toner 158 according to a difference of potential between first development potential VD1 and second development potential VD2 and to provide a second amount of second toner 208 at individual pixel locations having the first toner 158 according to the second net difference of potential Vnet2 between second development difference of potential VD2, the potential Vft of any first toner 158 at an individual engine pixel location and the image modulated potential Vepl at the individual engine pixel locations. When second net development difference of potential Vnet2 increases the amount of second toner 208 increases.

However, since second development difference of potential VD2 is not greater than initial difference of potential Vi, no second toner 208 deposits on portions of primary imaging member 112 that are unexposed during writing and that therefore have the initial difference of potential Vi. Thus, using the method of FIG. 6, it is possible to provide toner stack heights for toned regions of a receiver that are enhanced with additional toner stack height of the second toner 208 yet also offer reduced relief differentials.

FIGS. 7A-7C provide illustrations depicting the operation of the method of FIG. 6 at different engine pixel locations that have different image modulated difference of potential relative to ground Vepl when the method of FIG. 6 is used to provide a toner overcoat on toned portions of a receiver.

FIG. 7A shows an engine pixel location 250 on primary imaging member 112 that is charged to an initial difference of potential Vi. When engine pixel location 250 is moved through writing system 130 no exposure is made. This can occur, for example, where the image data for an image to be printed does not require any first toner 158 to be recorded at engine pixel location 250. Accordingly, the image modulated potential Vepl at engine pixel location 250 remains at the initial difference of potential Vi. Because in this example, first development difference of potential VD1 is not greater than initial difference of potential Vi, there is no net first development difference of potential between first development station 140 and engine pixel location 250 as engine pixel location 250 passes proximate to first development station 140. Accordingly, there is no development of first toner 158 to engine pixel location 250. Similarly, because in this example, the second development difference of potential VD2 is not greater than the initial difference potential Vi, there is no net second development difference potential Vnet2 as engine pixel location 250 is passed through toner overcoat system 200. Accordingly, there is no development of second toner 208 to engine pixel location 250 and engine pixel location 250 remains untoned.

FIG. 7B illustrates the operation of the method of FIG. 6 at another engine pixel location 252 that is highly modulated during writing. In this example, first development difference of potential VD1 and second development difference of potential VD2 are not greater than the initial difference of potential Vi. However, second development difference of potential VD2 is greater than first development difference of potential VD1 and both first development difference of potential VD1 and second development difference of potential VD2 are greater than the image modulated difference of potential Vepl of engine pixel location 252 which at engine pixel location 252, is at the lower difference of potential Vl.

When primary imaging member 112 is moved past first development station 140, first toner 158 deposits at engine pixel location 252 until an amount of the charged first toner 158 deposited at engine pixel location 252 reaches a first toner potential Vft that is determined by the first net development difference of potential Vnet1 between first development difference of potential VD1 and an image modulated difference of potential Vepl at engine pixel location 252 less a development shortfall 262 that arises due to a development efficiency that is less than unity.

As is further shown in FIG. 7B, when engine pixel location 252 reaches second development station 202, second development difference of potential VD2 is applied and second toner 208 is developed at engine pixel location 252 until an amount of second toner 208 deposited at engine pixel location 252 reaches a difference of potential of second toner Vst that is at a second net development difference of potential Vnet2 of the second development difference of potential VD2. The amount of second toner 208 can also be subject to a second development shortfall 265 where the development efficiency of the second development station 202 is less than unity.

Because, in this example, second development difference of potential VD2 is greater than first development difference of potential VD1, a first amount of second toner 208 is developed to engine pixel location 252 to provide a difference of potential of second toner Vft at engine pixel location 252 that is equal to the second development difference of potential VD2 less first development difference of potential VD1 less any development shortfall of second toner 208 due to development efficiency being less than unity. Further, a second amount of second toner 208 is developed at engine pixel location 252 to provide a difference of potential 268 of second toner 208 that has a difference of potential that is determined by the difference between the first development difference of potential VD1 and the first toner difference of potential Vft provided by first toner 158 developed at engine pixel location 252 during the first development.

In this embodiment, second development difference of potential VD2 is set at a level that is greater than first development difference of potential VD1 but not greater than initial difference of potential Vi. Accordingly, the amount of second toner 208 that deposits on an individual engine pixel location 252 during second development is modulated by the first toner difference of potential Vft of first toner 158 that is at engine pixel location 252. The second toner 208 is applied to each of the engine pixel locations in an amount that is modulated, at least in part based on a difference of potential Vft of a first toner 158 at the engine pixel location. This result is achieved without requiring the use of a separate printing module and the attendant need to generate an image to be printed by the separate printing module to apply second toner 208 in an imagewise fashion.

FIG. 7C illustrates the operation of the method of FIG. 6 at another engine pixel location 254 that is partially exposed during writing. In this example, first development difference of potential VD1 and second development difference of potential VD2 are likewise not greater than initial difference of potential Vi. However, second development difference of potential VD2 is greater than first development difference of potential VD1 and both first development difference of potential VD1 and second development difference of potential VD2 are greater than the image modulated difference of potential Vepl of engine pixel location 254 which is set at a potential between the higher difference of potential Vh and the lower difference of potential Vl.

When primary imaging member 112 is moved past first development station 140, first toner 158 deposits at engine pixel location 254 until the first toner 158 at engine pixel location 254 reaches a first toner difference of potential Vft that is generally the same as the first net development difference of potential Vnet1 of first development difference of potential VD1 less the image modulated difference of potential Vepl less a development shortfall 272 that arises due to development efficiency being less than unity.

As is further shown in FIG. 7C, when engine pixel location 254 reaches second development station 202, second development difference of potential VD2 is established and second toner 208 is developed at engine pixel location 254 in an amount to provide a net second development difference of potential Vnet2 of the second development difference of potential VD2 less the first toner difference of potential Vft and less the image modulated potential Vepl at engine pixel location 254. The actual amount of second toner 208 developed at engine pixel location 254 can also be subject to a second development shortfall 275.

In this embodiment, second development difference of potential VD2 is greater than first development difference of potential VD1, therefore a first portion of the second toner 208 that is developed at engine pixel location 254 to provide a net development difference of potential Vnet2 of second toner 208 at engine pixel location 254 that is about equal to the second development difference of potential VD2 less first development difference of potential VD1. Further, a second portion of second toner 208 can be developed at engine pixel location 254 to provide a second difference of potential 278 that has a potential relative to ground that is determined by the difference between the first development difference of potential VD1 and the first toner difference of potential Vft provided by first toner 158 developed at engine pixel location 254 during the first development.

In this embodiment, second development difference of potential VD2 is set at a level that is greater than first development difference of potential VD1 but not greater than initial difference of potential Vi. Accordingly as has been illustrated in FIGS. 7A-7C, no second toner 203 is applied at engine pixel locations that remain at the initial difference of potential Vi. The amount of second toner 208 that deposits on individual engine pixel locations 252 and 254 during second development is modulated by the first toner difference of potential Vft of first toner 158 that is at engine pixel location 254 and by any image modulated difference of potential Vepl. This result is achieved without requiring the use of a separate printing module and the attendant need to generate an image to be printed by the separate printing module to apply second toner 208 in an imagewise fashion.

FIGS. 8A and 8B conceptually illustrate amounts the first toner 158 that are developed at engine pixel locations 250, 252 and 254 presuming for the purposes of this discussion that first toner 158 and second toner 208 are developed in amounts that are proportional to the net first development difference of potential Vnet1, and the second net difference of potential Vnet2 as is discussed with reference to FIGS. 7A, 7B and 7C. Such presumptions are not critical but are used here to simplify this discussion. It will be appreciated that in other embodiments where first toner 158 or second toner 208 can develop as a function of first net development difference of potential Vnet1 and second net development difference of potential Vnet2 in amounts that are not relatively proportional. Compensation for such different contributions to the amount of first toner 158 and second toner 208 provided in response to the same net development difference of potential can be achieved through adjustments of the first development difference of potential VD1, second development difference of potential VD2, the image modulated potential at each engine pixel location Vepl, or the magnitude of the charge on first toner 158 or the second toner 208.

Similarly, for the purposes of FIGS. 8A and 8B it is assumed without limitation that first toner 158 and second toner 208 contribute to the toner stack height at a location on receiver 26 in a manner that is roughly equivalent for an equivalent amount of first toner 158 and second toner 208 thereon. However, here too this assumption is not critical and first toner 158 and second toner 208 can contribute to toner stack height at a location on receiver 26 in a different manner for an equivalent amount of first toner 158 and second toner 208 thereon. Here again compensation for such different manner of development can be made by adjustment of the first development potential VD1, second development potential VD2, the potential at each engine pixel location Vepl, or the magnitude of the charge on the first toner particles or the second toner particles.

As is shown in FIG. 8A, after development, engine pixel location 250 has no units of first toner 158 developed thereon. This yields a first toner stack height that is zero at engine pixel location 250 on primary imaging member 212. As is also shown in FIG. 8A, engine pixel location 252 has an amount of first toner 158 that creates seven units of stack height of first toner 158 and engine pixel location 254 has an amount of first toner 158 thereon to form a toner stack height of 4 units. Accordingly, in this case, a toner image that includes toner from engine pixel locations, 250, 252 and 256 provides a range of toner stack heights of at least 7 units of stack height in a first toner image 25 in this manner.

However, as is shown in FIG. 8B, when second toner 208 is applied in the manner described above with reference to FIGS. 7B and 7C, the toner stack height at engine pixel location 252 is 13 units, while the toner stack height at engine pixel location 254 is now 9 units; this yields a relief differential of 4/9 or about 44%. It will also be appreciated that such relief improvements can be further increased where it is possible to provide a greater separation in potential between first development difference of potential VD1 and second development difference of potential VD2.

It will be appreciated from this that in a DAD writing system that has the first development station 140 and toner layer enhancement system 200 as disclosed herein and that provides an initial charge of Vi that is generally greater than first development difference of potential VD1 and a second development difference of potential VD2, second toner 208 will not be attracted to engine pixel locations such as engine pixel location 250 of FIG. 7A on the photoreceptor 114 that are not exposed during the writing of the latent image as these engine pixel locations will remain at the initial difference of potential Vi and resist any toner transfer of the second toner 208. Further, second toner 208 is only transferred to engine pixel locations to which a full density amount of first toner 158 is transferred to the extent that is defined by the difference between second development difference of potential VD2 and first development difference of potential VD1.

In this way, second toner 208 can be used only where necessary and only to an extent necessary to provide a consistent coating of second toner 208 at what will be an uppermost layer of any engine pixel location having first toner 158 developed thereon and a fused after transfer using transfer subsystem 50. This can provide at toner image with a generally consistent index of refraction to improve one of the two factors influencing gloss as described above.

Further, precise registration of the second toner 208 with the first toner 158 at individual engine pixel location becomes possible without requiring imagewise placement of the second toner208 because the electrostatic forces that urge transfer of an amount of the second toner 208 to an engine pixel location such as engine pixel locations 250, 252 or 254 automatically develop desired amounts of second toner 208 at these engine pixel locations as a function of the same difference of potential at the engine pixel location Vepl used to develop the first toner and as a function of first toner actually located on the primary imaging member 112.

As is also shown in FIGS. 7A-7C, toner stack height variations caused by development efficiency limitations are compensated for by the additional toner stack height added by second toner 208. Importantly, this compensation is made at each pixel location a location without using the printing modules 40-48 in a print engine 22 to deliver image forming toner and without requiring that a printer controller 82 perform color separation processing, then calculate toner stack heights, and then assemble a toner image.

It will also be appreciated that in certain embodiments, it can be useful for a printer 20 to generate prints 70 that have, effectively, an overcoat of second toner 208 even in portions of receiver 26 that do not have first toner 158 developed thereon. This can be done for example where receiver 26 has a post fused gloss that is not consistent with the post fused gloss of a second toner 208. In such a case or for other reasons, adjustment of the second development difference of potential VD2 above the initial difference of potential Vi allows coverage of the receiver 26 with second toner 208.

This is illustrated in FIGS. 9A-9C, in which it is shown that by providing a second development difference potential VD2 above initial difference of potential Vi and first development difference of potential VD1, it becomes possible to deposit second toner 208 on both engine pixel locations having first toner 158 as is generally described above and also to provide toner on untoned portions of receiver 26 that has a thickness that is determined by the difference of potential between the second development potential VD2 and the initial difference of potential Vi.

As can be seen from FIG. 9A, where engine pixel location 250 is charged to an initial difference of potential Vi and is not discharged, and no first toner 158 will develop to engine pixel location 250. However, because second development difference of potential VD2 is greater than initial difference of potential Vi an amount of second toner 208 will develop at engine pixel location 250 because there is a net difference in potential between the initial difference of potential Vi and the second development difference of potential VD2. The amount of second toner 208 deposited at a fully exposed engine pixel location 252 and a partially exposed engine pixel location 254 are similar to those described above with respect to FIGS. 7B and 7C respectively, however, with an additional amount of second toner 208 provided according to the difference in potential between the second development difference of potential VD2 and the initial difference of potential Vi.

As has been discussed elsewhere herein the second development difference of potential V2 exceeds the first development difference of potential VD1. In one embodiment second development difference of potential VD2 exceeds the first development difference of potential VD1 by at least about 25 percent. This advantageously creates a relatively thick layer of second toner 208, and further allows additional net second development difference of potential Vnet2 during the development of second toner 208 to enable higher efficiency development at least during a portion of the second development.

In the embodiments described above, second toner 208 has been described as being applied onto one or more first toners 158. First toner 158 is referred to in various places as a color toner, or has been described as providing differently colored toners or that form images according to color separation images. This has been done for convenience only and is not limiting. A first toner 158 can be applied according to any type of image or pattern and the color of the first toner 158 is not critical. Without limitation, a first toner 158 can be applied according to any first toner pattern such as a pattern that defines a structure that is to be formed on receiver 26 or an arrangement of toners that are of a type or that are applied in patterns that are intended to achieve functional outcomes such as forming structures, optical elements, electrical circuit components or circuits or desirable arrangements of biological material or components thereof.

What is claimed is:

1. A method for printing, the method comprising the steps of:

charging engine pixel locations of a primary imaging member with an image modulated difference of potential of a first polarity between a higher difference of potential and a lower difference of potential relative to a ground;

establishing a first development difference of potential of the first polarity between the higher difference of potential and the lower difference of potential at a first development station to form a first net development difference of potential between the first development station and individual engine pixel locations on the primary imaging member, with the first net development potential being the first development difference of potential less any image modulated difference of potential at the engine pixel location;

positioning a first toner charged at the first polarity at the first development station, such that the first toner is electrostatically urged to deposit in the individual engine pixel locations according to the first net development difference of potential for the individual engine pixel locations;

establishing a second development difference of potential of the first polarity at a second development station to form a second net development difference of potential between the second development station and the individual engine pixel locations on the primary imaging member, with the second net development difference of potential being the second development difference of potential less any image modulated difference of potential at the individual engine pixel location and less any difference of potential relative to ground of any first toner at the individual engine pixel location; and positioning a second toner of the first polarity at the second development station such that the second toner is electrostatically urged by the second net development difference of potential to deposit on the individual engine pixel locations having first toner;

wherein the second development difference of potential is greater than the first development difference of potential to cause the second toner to deposit on the individual engine pixel locations having first toner in an amount according to the second net development difference of potential and wherein the second toner is different from the first toner.

2. The method of claim 1, wherein the second toner is clear when fused and the first toner is not clear.

3. The method of claim 1, wherein the second toner has toner particles that are of a diameter that is different than toner particles of the first toner.

4. The method of claim 1, wherein the second toner has toner particles that are formed from a different material composition than toner particles of the first toner.

5. The method of claim 1, wherein the second toner has a different glass transition temperature than the first toner.

6. The method of claim 1, wherein the second toner has a lower glass transition temperature than the first toner.

7. The method of claim 1 further comprising the step of transferring the first toner and the second toner onto an intermediate transfer member and then transferring the first toner and the second toner from the intermediate transfer member onto a receiver.

8. The method of claim 1, wherein the first toner, the second toner and the primary imaging member are negatively charged.

9. The method of claim 1, wherein a difference of potential between the second development difference of potential and the first development difference of potential is at least 25 percent of the first development difference of potential.

10. The method of claim 1, wherein the selected engine pixel locations on the primary imaging member are charged by creating an initial difference of potential relative to ground at the engine pixel locations on a photoreceptor of the primary imaging member and exposing the engine pixel locations to light to discharge engine pixel locations to an extent that is generally proportional to density information in an image while leaving other engine pixel locations at the initial difference of potential.

11. The method of claim 10, wherein the second development difference of potential is greater than the initial difference of potential such that second toner is applied to engine pixel locations on which no first toner is recorded according to the difference in potential between the second development difference of potential and the initial difference of potential.

12. The method of claim 1, wherein the first toner comprises a toner of a first color having a first hue and wherein the second toner comprises a toner having the first color and a second different hue.

13. The method of claim 1, wherein the first toner comprises a toner of a first viscosity and the second toner comprises a toner of a second viscosity that is different from the first viscosity.

14. The method of claim 1, wherein the first toner has first color characteristics and the second toner has different second color characteristics.

15. The method of claim 1, wherein the electrostatic forces that urge transfer of an amount of the second toner to an engine pixel location automatically register the second toner with the engine pixel location.

16. The method of claim 1, wherein a first portion of the amount of second toner that develops at an individual engine pixel location having first toner is in an amount that develops according to a difference of potential between the first development difference of potential and the second development difference of potential and a second portion develops at the individual engine pixel location is an amount according to a difference of potential between the first development difference of potential and the first toner difference of potential at the engine pixel location.

* * * * *